US012331539B2

(12) United States Patent
Rogers et al.

(10) Patent No.: US 12,331,539 B2
(45) Date of Patent: Jun. 17, 2025

(54) LEG FOR A FRAME ASSEMBLY FOR USE WITH ORCHESTRA PIT FILLERS OR STAGE EXTENSIONS

(71) Applicant: STAGERIGHT CORPORATION, Clare, MI (US)

(72) Inventors: Grant Rogers, Sanford, MI (US); Ryan Johnson, Clare, MI (US)

(73) Assignee: STAGERIGHT CORPORATION, Clare, MI (US)

( * ) Notice: Subject to any disclaimer, the term of this patent is extended or adjusted under 35 U.S.C. 154(b) by 317 days.

(21) Appl. No.: 18/107,215

(22) Filed: Feb. 8, 2023

(65) Prior Publication Data

US 2024/0263472 A1 Aug. 8, 2024

(51) Int. Cl.
*E04H 3/24* (2006.01)
*A63J 1/00* (2006.01)

(52) U.S. Cl.
CPC . *E04H 3/24* (2013.01); *A63J 1/00* (2013.01)

(58) Field of Classification Search
CPC . E04H 3/24; E04H 3/28; E04G 25/061; A63J 1/00; Y10T 403/32508
See application file for complete search history.

(56) References Cited

U.S. PATENT DOCUMENTS 2,510,767 A * 6/1950 Vocisano ..... E04G 25/04 249/210
2,685,353 A * 8/1954 Caskie ..... E04H 12/182 403/108
3,964,402 A 6/1976 Jenne'et al.
4,234,151 A * 11/1980 John ..... E04G 25/065 248/354.3
4,332,116 A * 6/1982 Buchanan ..... E04B 7/028 52/169.4
4,759,162 A * 7/1988 Wyse ..... E04H 3/24 52/126.6
5,848,501 A 12/1998 Taipale et al.
6,581,339 B2 * 6/2003 Thiede ..... E04H 3/24 407/7
7,874,115 B2 1/2011 Thiede
8,117,787 B2 * 2/2012 Lee ..... E04G 25/061 403/109.5
10,221,581 B2 3/2019 Phillips
11,428,015 B2 8/2022 Huss et al.
2002/0116885 A1 * 8/2002 Thiede ..... E04H 3/24 52/263
2006/0185258 A1 8/2006 Ouellet et al.
(Continued)

FOREIGN PATENT DOCUMENTS

CN 110878651 A 3/2020
GB 2456817 B 3/2010

OTHER PUBLICATIONS

Orchestra pit filler projects. https://www.sightlinecommercial.com/application/orchestra-pit-filler/.

(Continued)

*Primary Examiner* — Christine T Cajilig
(74) *Attorney, Agent, or Firm* — Carlson, Gaskey & Olds, P.C.

(57) ABSTRACT

This disclosure relates to a leg for frame assembly for use with an orchestra pit filler or a stage extension. Among other benefits, the leg increases the ease of assembling an orchestra pit filler or stage extension.

19 Claims, 6 Drawing Sheets

(56) References Cited

U.S. PATENT DOCUMENTS

| | | | | |
|---|---|---|---|---|
| 2006/0186284 | A1* | 8/2006 | Root | F16M 11/10<br>248/161 |
| 2022/0064975 | A1 | 3/2022 | Bechtol et al. | |

OTHER PUBLICATIONS

Strata® Orchestra pit filler. Wenger. (n.d.). Retrieved Feb. 8, 2023, from https://shop.wengercorp.com/education/stratar-orchestra-pit-filler.html.

* cited by examiner

LEG FOR A FRAME ASSEMBLY FOR USE WITH ORCHESTRA PIT FILLERS OR STAGE EXTENSIONS

TECHNICAL FIELD

This disclosure relates to a leg for frame assembly for use with an orchestra pit filler or a stage extension.

BACKGROUND

Theaters, including playhouses, opera houses, performing arts centers, and concert halls, typically include a stage for performers and a seating area for an audience. Some theaters also include an orchestra pit that is usually located in a lowered area between the stage and the seating area. In particular, the orchestra pit is typically immediately in front of the stage.

During stage performances that do not use an orchestra, the orchestra pit can be filled, either partially or fully. The orchestra pit may be filled using a system, referred to as an orchestra pit filler, that includes a frame assembly and a plurality of panels, which may be referred to as deck panels or simply decks. The panels are supported above the lowered area of the orchestra pit by the frame assembly. Stage extensions are systems, similar to orchestra pit fillers, that include a frame assembly supporting a plurality of panels in front of a stage.

Both orchestra pit fillers and stage extensions can be configured such that the deck panels are substantially aligned with the stage, such that the deck panels essentially increase the effective surface area of the stage, which allows stage performers to be closer to the seating area.

SUMMARY

In some aspects, the techniques described herein relate to a system for at least partially filling an orchestra pit or extending a stage, including: a frame assembly including a leg, wherein the leg includes an outer leg portion, an inner leg portion partially within the outer leg portion, and a support fastener, and wherein a bottom edge of the inner leg portion is configured to rest on a top of the support fastener.

In some aspects, the techniques described herein relate to a system, wherein the support fastener is a pin.

In some aspects, the techniques described herein relate to a system, wherein: the leg includes a connection assembly configured to connect the outer leg portion to the inner leg portion, and the connection assembly includes a collar.

In some aspects, the techniques described herein relate to a system, wherein: the outer leg portion includes a plurality of sets of openings configured to receive the pin, each set of openings includes two vertically aligned openings formed in opposite sides of the outer leg portion, each set of openings is vertically spaced-apart from each of the other sets of openings, and each set of openings is vertically below the collar.

In some aspects, the techniques described herein relate to a system, wherein: the collar includes a central opening, the central opening includes a first portion and a second portion having a diameter less than the first portion, and an upper edge of the outer leg portion is received in the first portion.

In some aspects, the techniques described herein relate to a system, wherein the inner leg portion is arranged in the central opening such that the bottom edge of the inner leg portion is vertically below the collar.

In some aspects, the techniques described herein relate to a system, wherein the second portion is above the first portion.

In some aspects, the techniques described herein relate to a system, wherein the collar includes a ledge between the first and second portions of the central opening, and wherein the ledge rests on the upper edge of the outer leg portion.

In some aspects, the techniques described herein relate to a system, wherein: a first set of fasteners connect the collar to the outer leg portion, and a second set of fasteners connect the collar to the inner leg portion.

In some aspects, the techniques described herein relate to a system, wherein: the inner leg portion includes a plurality of channels, the second set of fasteners includes a plurality of nuts, each of the nuts is arranged in a corresponding one of the channels, and the second set of fasteners includes a plurality of bolts configured to project through corresponding openings in the collar to engage with a corresponding one of the nuts.

In some aspects, the techniques described herein relate to a system, wherein the plurality of channels are tapered toward a central axis of the inner leg portion.

In some aspects, the techniques described herein relate to a system, wherein: an outer surface of the inner leg portion is substantially polygonal in cross-section, the outer surface of the inner leg portion includes a plurality of slots, and each of the slots leads to one of the plurality of channels.

In some aspects, the techniques described herein relate to a system, wherein an inner surface of the outer leg portion is substantially polygonal in cross-section and substantially matches a shape of the outer surface of the inner leg portion.

In some aspects, the techniques described herein relate to a system, wherein the inner surface of the outer leg portion and the outer surface of the inner leg portion are both substantially octagonal in cross-section.

In some aspects, the techniques described herein relate to a system, wherein the leg includes a support channel attached adjacent a top edge of the inner leg portion, wherein the support channel is configured to at least partially support a beam.

In some aspects, the techniques described herein relate to a system, wherein the leg includes an adjustable leveling foot assembly attached adjacent a bottom edge of the outer leg portion.

In some aspects, the techniques described herein relate to a method of at least partially filling an orchestra pit or extending a stage, including: erecting a frame assembly by arranging an inner leg portion of a leg partially within an outer leg portion such that a bottom edge of the inner leg portion rests rest on a top of a support fastener inserted through openings in the outer leg portion.

In some aspects, the techniques described herein relate to a method, wherein the step of erecting the frame assembly includes connecting the inner leg portion to the outer leg portion using a collar of a connection assembly.

In some aspects, the techniques described herein relate to a method, wherein the step of erecting the frame assembly includes adjusting a leveling foot assembly adjacent a bottom edge of the outer leg portion.

In some aspects, the techniques described herein relate to a method, further including: supporting a tension grid panel or a deck panel using the frame assembly.

DETAILED DESCRIPTION

This disclosure relates to a leg for frame assembly for use with an orchestra pit filler or a stage extension. Among other benefits, the leg increases the ease of assembling an orchestra pit filler or stage extension.

Figure 1:
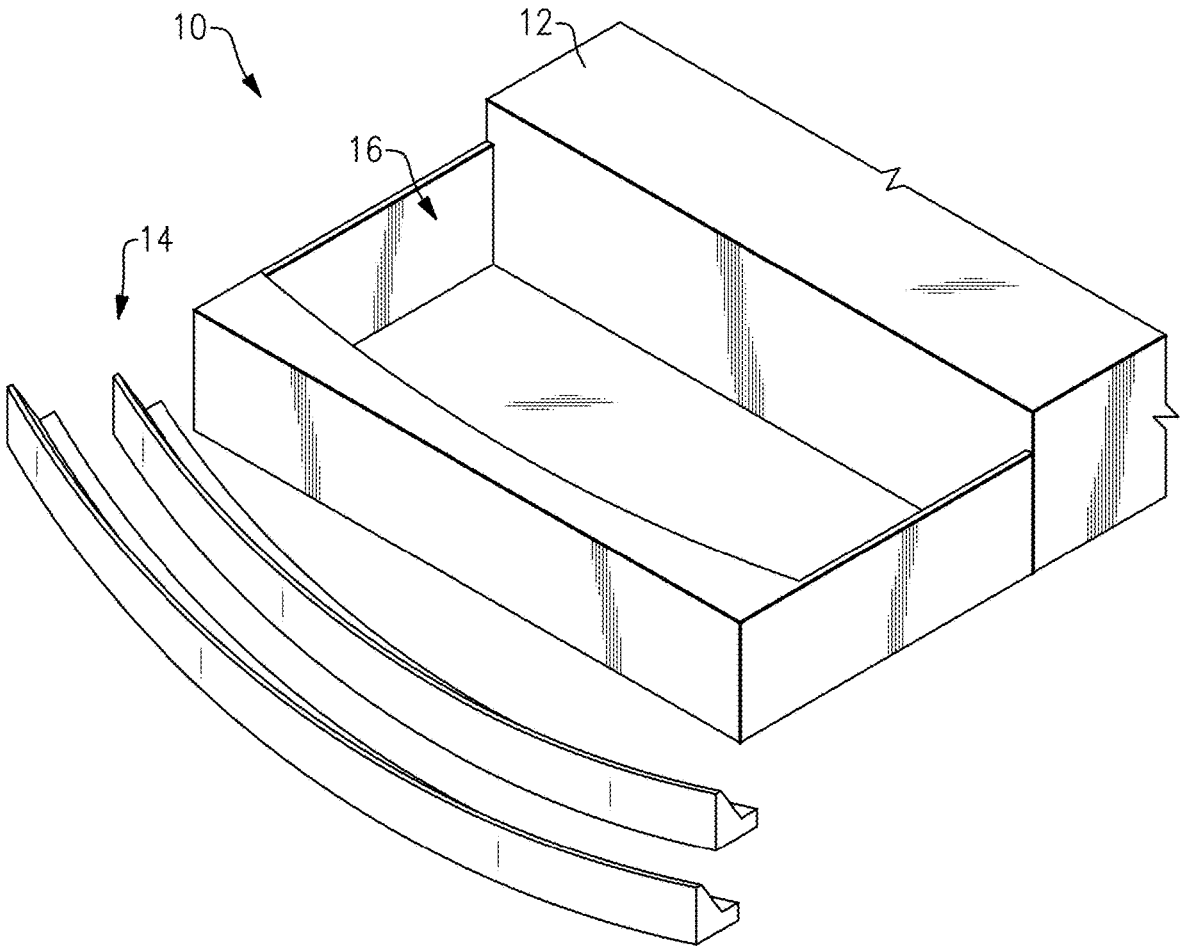
FIG. 1 is a perspective view of a portion of a theatre, including an orchestra pit.

FIG. 1 illustrates a portion of a theatre 10 from a perspective of an audience. The theatre 10 includes a stage 12, a seating area 14, and an orchestra pit 16. The orchestra pit 16 is a lowered area between the stage 12 and the seating area 14. In this example, the orchestra pit 16 is immediately in front of the stage 12.

This disclosure is not limited to any particular type of theatre 10. To this end, the term theatre is used broadly in this disclosure to refer to any venue with a stage and a seating area, including playhouses, opera houses, performing arts centers, concert halls, auditoriums, etc. The term theatre is inclusive of venues with stages that are fixed or portable, and is further inclusive of venues with seating areas that have fixed, retractable, or portable seats.

This disclosure is not limited to venues with an orchestra pit. To this end, while orchestra pit fillers are mentioned herein, this disclosure extends to stage extensions.

Figure 2:
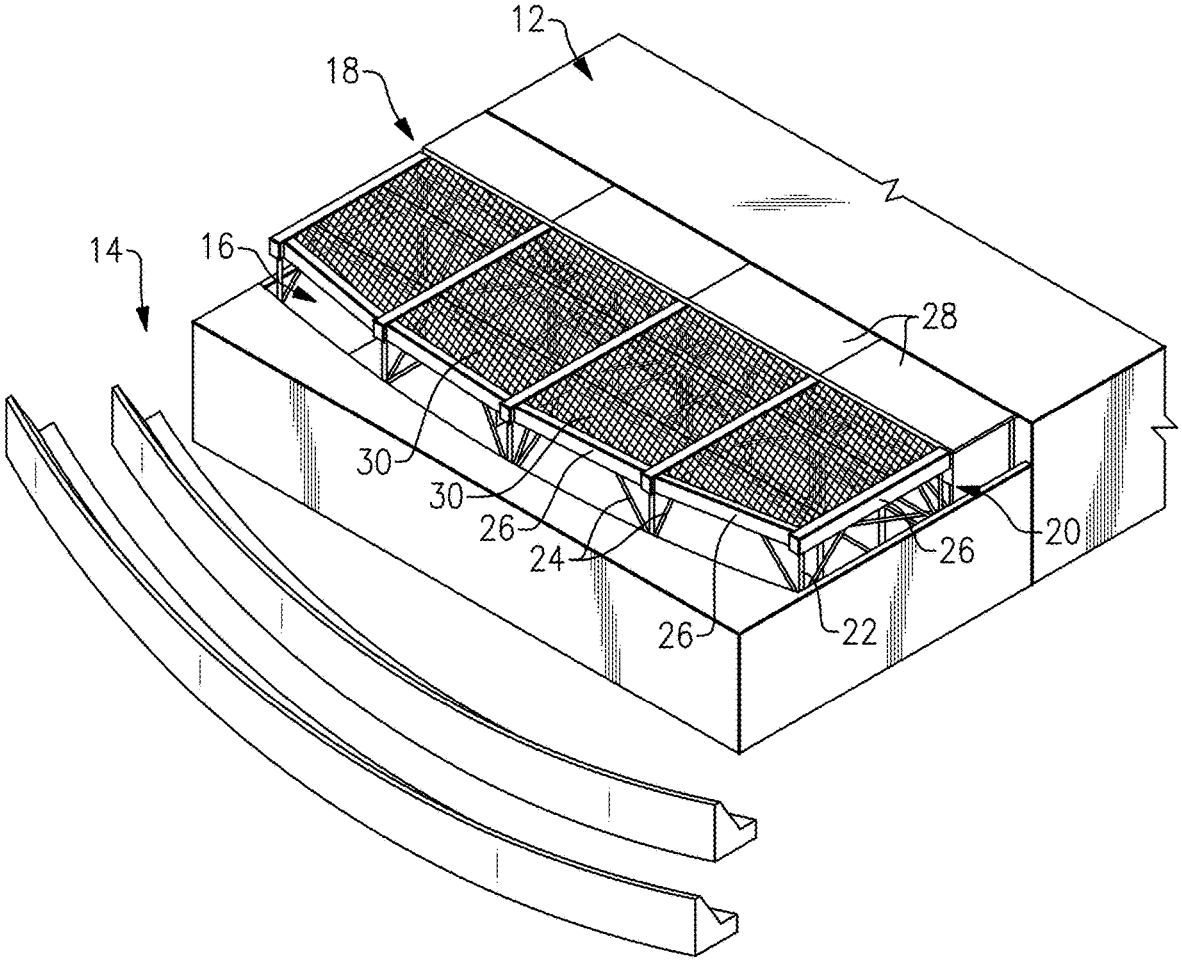
FIG. 2 is a similar view to FIG. 1, but illustrates an orchestra pit filler.

FIG. 2 illustrates the same portion of the theatre 10 of FIG. 1, but with an orchestra pit filler 18 arranged in the orchestra pit 16. In this example, the orchestra pit filler 18 includes a frame assembly 20 including a plurality of vertically-extending legs 22, braces 24, and beams 26. The beams 26 are supported adjacent a top of the legs 22 and are configured to support deck panels 28 and/or tension grid panels 30. As shown in FIG. 2, the frame assembly 20 supports a plurality (specifically, four) deck panels 28 such that the deck panels 28 abut a front edge of the stage 12 and such that a top of the deck panels 28 is substantially vertically aligned with a top of a front portion of the stage 12. In this way, the deck panels 28 are readily accessed from the stage 12, and performers and/or set pieces can be supported by the deck panels 28, which effectively increases the surface area of the stage 12.

In this example, the deck panels 28, which may be referred to simply as decks, are substantially solid and may be made primarily of a wood or composite material, for example. The orchestra pit filler 18 also includes a plurality of tension grid panels 30 supported by the frame assembly 20.

Figure 3:
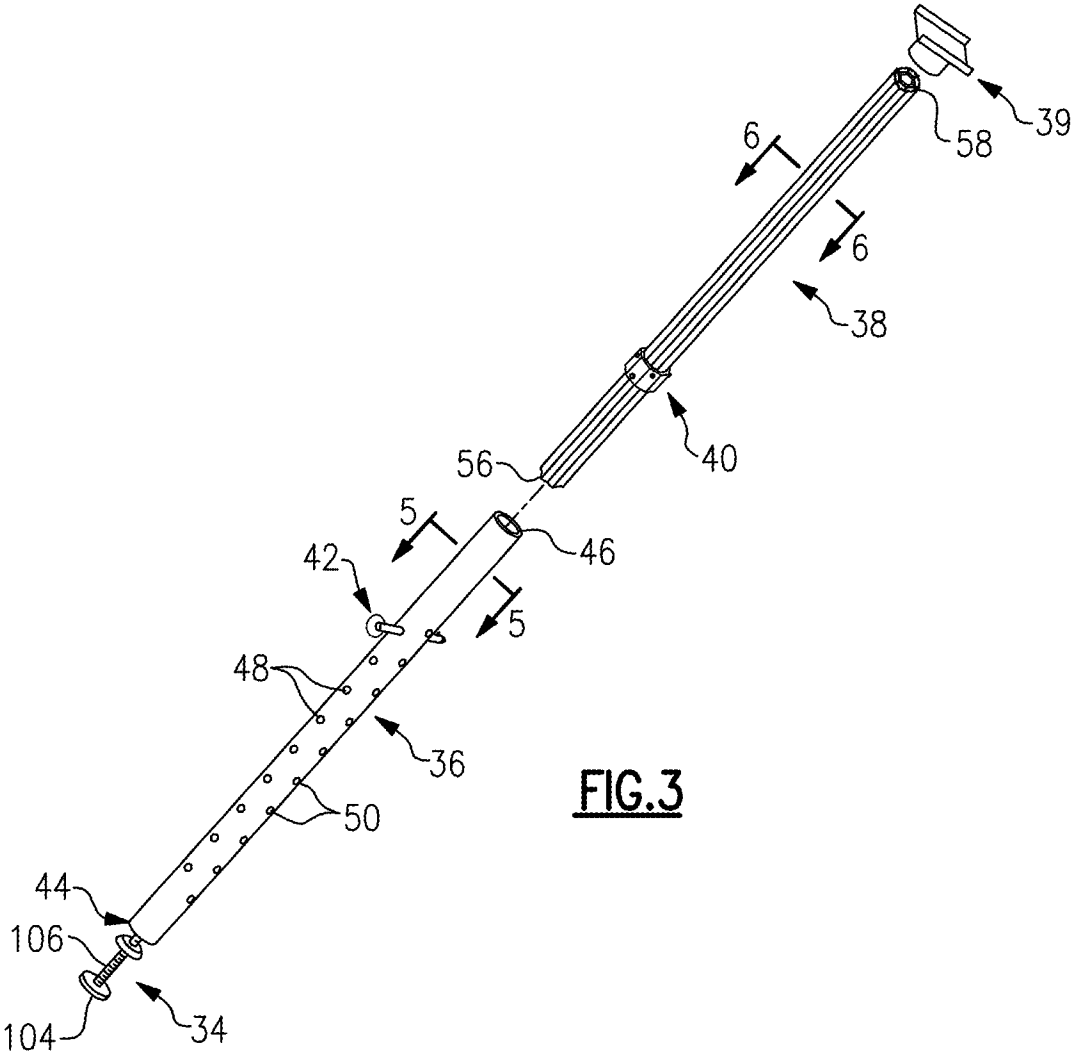
FIG. 3 is a perspective, exploded view of an example leg.

An example leg 22 is shown in more detail in FIG. 3, which is an exploded view of the leg 22. In general, the leg 22 includes an adjustable leveling foot assembly 34, an outer leg portion 36, an inner leg portion 38, and a support channel 39. The adjustable leveling foot assembly 34 is configured to interface with a floor of the orchestra pit 16 and the support channel 39 is configured to at least partially support one or more beams 26 from below. The outer leg portion 36 and the inner leg portion 38 are selectively connected to one another in order to adjust the effective height of the leg 22. In this example, the inner leg portion 38 is arranged partially within the outer leg portion 36. A connection assembly 40 and support fastener 42 are configured to facilitate the connection between the outer leg portion 36 and the inner leg portion 38.

Figure 4:
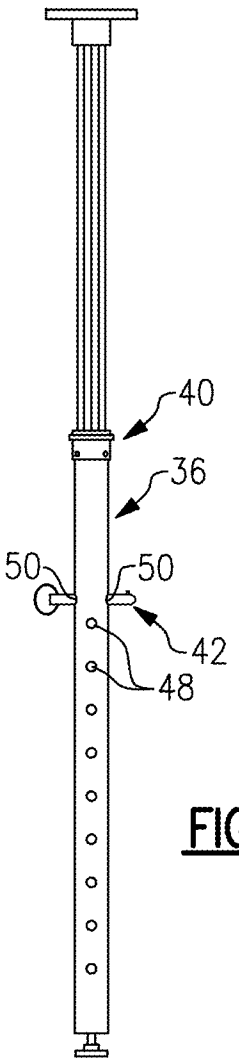
FIG. 4 is an end view of the example leg in an assembled state.
Figure 5:
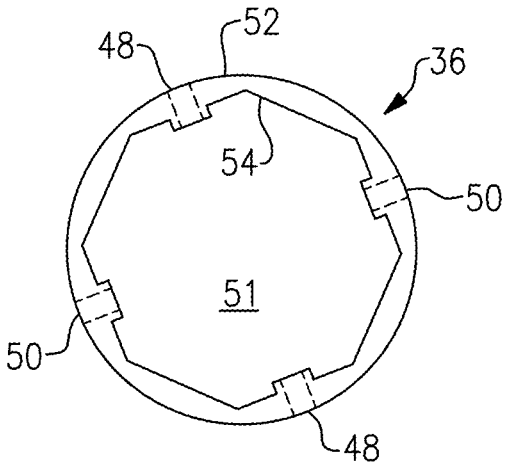
FIG. 5 is a cross-sectional view of an outer leg portion taken along line 5-5 in FIG. 3.

In this example, the outer leg portion 36 extends from a bottom edge 44 to a top edge 46. Between the bottom and top edges 44, 46, the outer leg portion 36 includes a plurality of sets of openings 48, 50. Each set of openings 48, 50 includes a plurality of pairs of openings, and each pair is configured to receive the support fastener 42. In this example, the outer leg portion 36 includes a first set of openings 48 including a plurality of pairs of openings vertically aligned with one another on opposite sides of the outer leg portion 36. Further, the outer leg portion 36 includes a second set of openings 50 including a plurality of pairs of openings vertically aligned with one another on opposite sides of the outer leg portion 36. The second set of openings 50 are arranged at different vertical positions than the first set of openings 48 and are arranged on different sides of the outer leg portion 36 than the first set of openings 48. In this example, second set of openings 50 are arranged at a 900 angle relative to adjacent ones of the first set of openings 48, as generally shown in FIGS. 4 and 5. Each of the first and second sets of openings 48, 50 is vertically below the connection assembly 40, as shown in FIG. 4. While there are two sets of openings 48, 50 in this example, this disclosure encompasses outer leg portions 36 with one or more sets of openings.

The outer leg portion 36 is substantially hollow and includes a hollow central region 51, as shown in FIG. 5. The outer leg portion 36 exhibits a substantially constant cross-section along its entire length. An outer surface 52 is substantially circular in cross-section. The inner surface 54 is substantially polygonal in cross-section, and in particular is octagonal. The outer leg portion 36 may be made of a metallic material and may be formed using an extrusion process.

The inner leg portion 38 extends from a bottom edge 56 to a top edge 58. The inner leg portion 38 exhibits a substantially constant cross-section along its entire length. In cross-section, shown in FIG. 6, the inner leg portion 38 includes a hollow central region 60 about a central axis 62 thereof. Radially outward of the hollow central region 60, the inner leg portion 38 includes a plurality of channels 64. Further, an outer surface 66 of the inner leg portion 38 is substantially polygonal in cross-section, and in particular is shaped to correspond to a shape of the inner surface 54 of the outer leg portion 36. Further, the outer surface 66 of the inner leg portion 38 is sized and shaped so as to permit the inner leg portion 38 to slide into the hollow central region 51 of the outer leg portion. The polygonal shape and relative sizing of the outer leg portion 36 and the inner leg portion 38 prevents relative rotation. The outer surface 66 of the inner leg portion 38 and the inner surface 54 of the outer leg portion 36 are substantially octagonal in this example. This disclosure extends to other polygonal shapes. Further, the inner leg portion 38 may be made of a metallic material and may be formed using an extrusion process.

The outer surface 66 of the inner leg portion 38 includes eight sides and eight channels 64, with each of the channels 64 corresponding to one of the sides of the outer surface 66. The inner leg portion 38 further includes a plurality of slots 68 through the outer surface 66 and leading to a corresponding one of the channels 64. The channels 64 are tapered such that the channels 64 gradually reduce in dimension leading toward the central axis 62.

The connection assembly 40 is shown in detail in FIGS. 7-10. With joint reference to those drawings, the connection assembly includes a collar 70. The collar 70 circumscribes the outer and inner leg portions 36, 38 and is used to connect the outer and inner leg portions 36, 38.

The collar 70 includes a central opening 72 (FIG. 9) extending through an entirety of a height of the collar 70. The central opening 72 includes a first portion 74 and a second portion 76 having a diameter less than the first portion 74. The second portion 76 is vertically above the first portion 74. Between the first portion 74 and the second portion 76, the collar 70 includes a ledge 78. The collar 70 is configured such that the ledge 78 can rest on the upper edge 46 of the outer leg portion 36.

The collar 70 further includes a first set of openings 80 extending through the first portion 74 and a second set of openings 82 extending through the second portion 76. Further, a first set of fasteners 84 (FIG. 7) extend through the first set of openings 80 to connect the collar 70 to the outer leg portion 36. The first set of fasteners 84 may be threaded bolts configured to engage threaded openings formed in the outer leg portion 36 adjacent the top edge 46.

A second set of fasteners 86 extend through the second set of openings 82 to connect the collar 70 to the inner leg portion 38. The second set of fasteners 86 includes threaded bolts and nuts 88, with each bolt configured to engage with a corresponding nut 88. The nuts 88 are arranged in a corresponding one of the channels 64.

Figure 6:
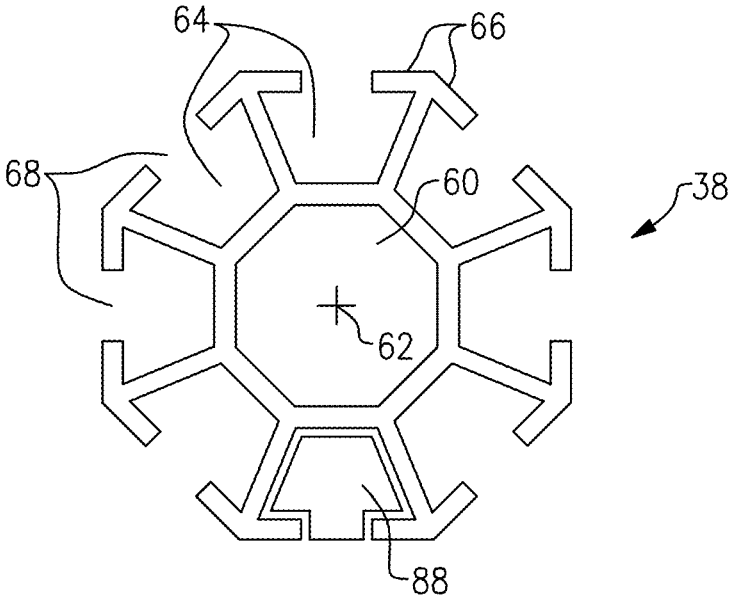
FIG. 6 is a cross-sectional view of an inner leg portion taken along line 6-6 in FIG. 3.
Figure 7:
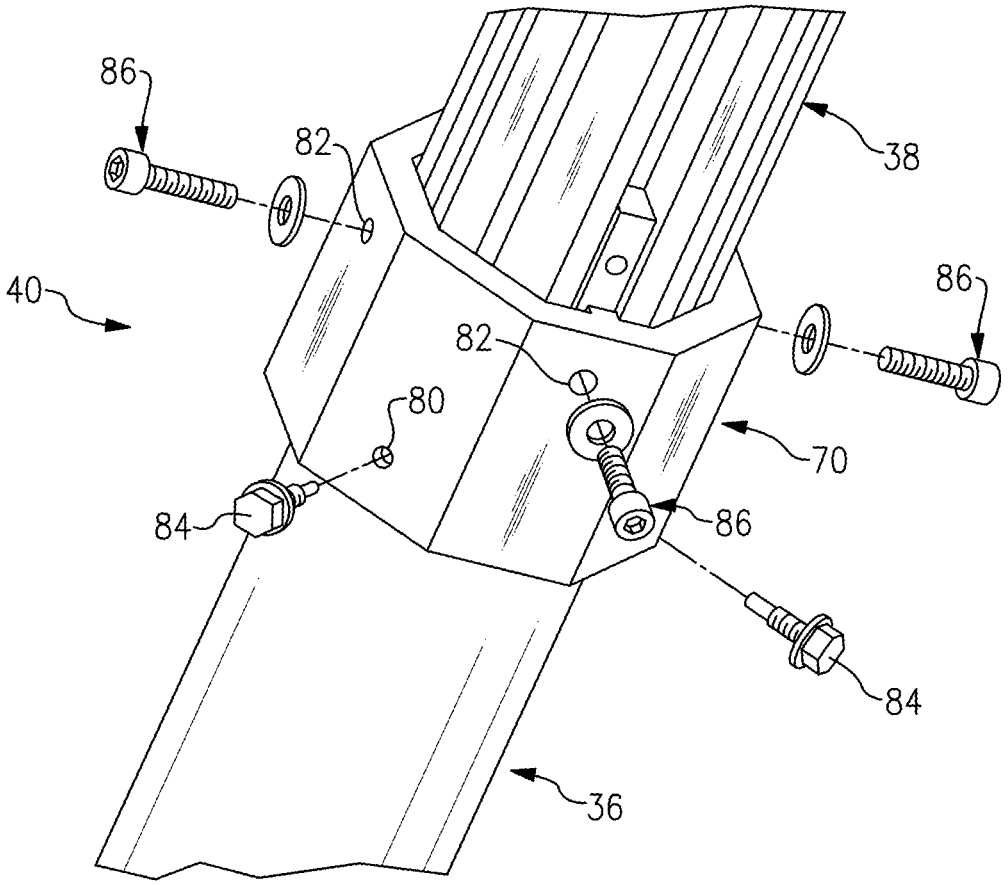
FIG. 7 is a close-up view of a portion of a connection assembly of the leg.
Figure 8:
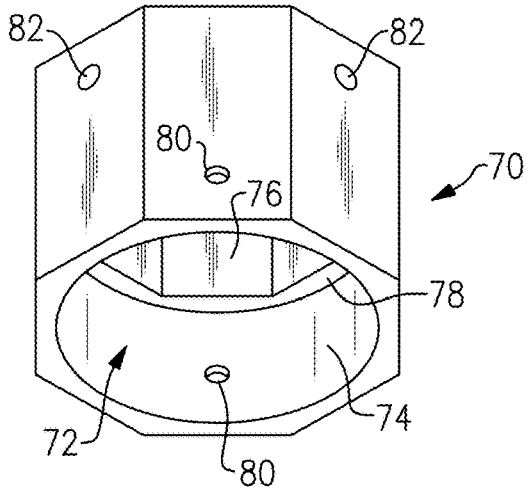
FIG. 8 is a bottom perspective view of an example collar.
Figure 9:
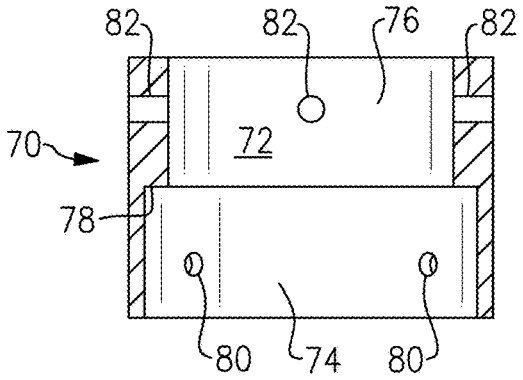
FIG. 9 is a cross-sectional view of the example collar.
Figure 10:
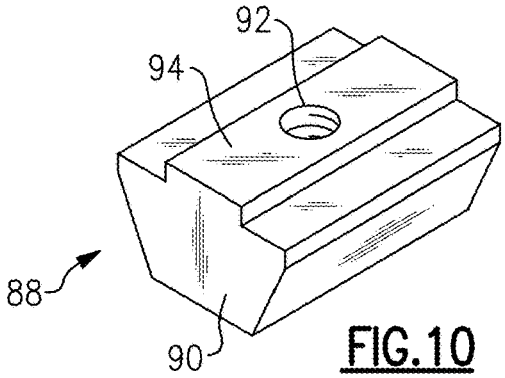
FIG. 10 is a perspective view of an example nut.

One example nut 88 is shown in a channel 64 in FIG. 6. Detail of an example nut 88 is shown in FIG. 10. As shown, the nut 88 includes a tapered body 90 sized and shaped to permit the nut 88 to fit within one of the channels 64 and to slide within the channel 64 along a length of the channel 64, without the nut 88 coming out of the corresponding slot 68. A threaded opening 92 is configured to interface with the threaded bolts of the second set of fasteners 86. The threaded opening 92 is provided on a standoff 94 projecting from the body 90 and at least partially into the slot 68.

Figure 11:
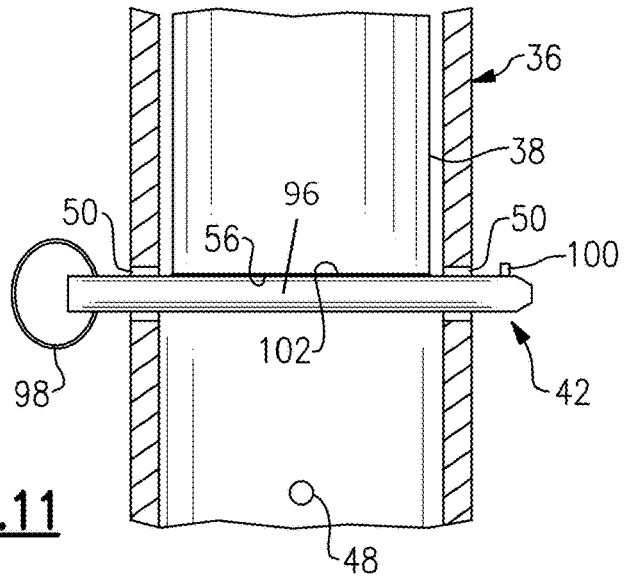
FIG. 11 is a cross-sectional view representative of an arrangement of the outer leg portion, inner leg portion, and a support fastener.

When assembling the leg 22, the collar 70 can first be connected to the inner leg portion 38, such as by loosely tightening some of the second set of fasteners 86. Further, a user can approximate the required height of the leg 22 and place the support fastener 42 through a corresponding pair of openings from the first and second sets of openings 48, 50. In FIGS. 4 and 11, a user has inserted the support fastener 42 through the top-most openings, which is a pair of openings in the second set of openings 50.

The support fastener 42 in this example is a pin including an elongate, straight shaft 96 extending through each opening in the top-most pair of openings. The shaft 96 exhibits a longitudinal axis substantially perpendicular to the longitudinal axes of the outer and inner leg portions 36, 38. The support fastener 42 is a cotter pin in one example. The support fastener 42 may include features, such as a ring 98 or detent 100, configured to prevent or resist sliding of the support fastener 42 relative to the pair of openings. This disclosure is not limited to any particular type of support fastener. The support fastener could be a bolt, in another example.

With the support fastener 42 in place, the inner leg portion 38 is inserted into the hollow central region 51 of the outer leg portion 36 until the bottom edge 56 of the inner leg portion 38 directly contacts the support fastener 42, and in particular contacts a top 102 of the shaft 96. The inner leg portion 38 is configured to rest on the top 102 of the support fastener 42. The support fastener 42 is able to bear the entire weight of the inner leg portion 38 and any associated loads, such as the load of any deck panel or tension grid panel connected to the inner leg portion 38.

With the inner leg portion 38 resting on the support fastener 42, a user may situate the collar 70 such that the ledge 78 rests on the top edge 46 of the outer leg portion 36. The user may then fully tighten the first and second sets of fasteners 84, 86 to connect the collar 70 to the outer leg portion 36 and the inner leg portion 38. The ease of connecting the collar 70 to the outer and inner leg portions 36, 38 is increased because the inner leg portion 38 can rest on the support fastener 42 while situating the collar 70 and tightening the first and second sets of fasteners 84, 86. For example, there is no need for a second user to hold the inner leg portion 38 in place while a first user arranges the collar 70 and tightens the first and second sets of fasteners 84, 86. This aspect of the disclosure increases the ease of assembly.

To complete the installation, the adjustable leveling foot assembly 34, which in this example includes a foot 104 and a threaded shaft 106, is adjusted, if necessary, to raise and lower the leg 22, and the support channel 39 is arranged relative to one or more of the beams 26.

After installation, the inner leg portion 38 is configured to rest on the top 102 of the support fastener 42 in one example. In another example, the bottom edge 56 of the inner leg portion 38 is spaced-apart above the support fastener 42. In both examples, the support fastener 42 acts a standby support for the inner leg portion 38 and any associated loads, such as beams, deck panels, etc., in case the inner leg portion 38 becomes detached from the collar 70.

It should be understood that terms such as "top," "bottom," "vertical," "lateral," "upward," and "downward" are used above with reference to the normal meaning with reference to the normal orientation of the structures described in the drawings. Terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A system for at least partially filling an orchestra pit or extending a stage, comprising:

a frame assembly including a leg, wherein the leg comprises an outer leg portion, an inner leg portion partially within the outer leg portion, and a support fastener, wherein a bottom edge of the inner leg portion is configured to rest on a top of the support fastener, and wherein the leg further comprises a collar, and wherein a first set of fasteners connect the collar to the outer leg portion and a second set of fasteners connect the collar to the inner leg portion.

2. The system as recited in claim 1, wherein the support fastener is a pin.

3. The system as recited in claim 2, wherein:

the leg comprises a connection assembly configured to connect the outer leg portion to the inner leg portion, and the connection assembly includes the collar.

4. The system as recited in claim 3, wherein:

the outer leg portion includes a plurality of sets of openings configured to receive the pin, each set of openings includes two vertically aligned openings formed in opposite sides of the outer leg portion, each set of openings is vertically spaced-apart from each of the other sets of openings, and each set of openings is vertically below the collar.

5. The system as recited in claim 3, wherein:

the collar includes a central opening, the central opening includes a first portion and a second portion having a diameter less than the first portion, and an upper edge of the outer leg portion is received in the first portion.

6. The system as recited in claim 5, wherein the inner leg portion is arranged in the central opening such that the bottom edge of the inner leg portion is vertically below the collar.

7. The system as recited in claim 5, wherein the second portion is above the first portion.

8. The system as recited in claim 5, wherein the collar includes a ledge between the first and second portions of the central opening, and wherein the ledge rests on the upper edge of the outer leg portion.

9. A system for at least partially filling an orchestra pit or extending a stage, comprising:

a frame assembly including a leg, wherein the leg comprises an outer leg portion, an inner leg portion partially within the outer leg portion, and a support fastener, and wherein a bottom edge of the inner leg portion is configured to rest on a top of the support fastener, wherein the support fastener is a pin wherein the leg comprises a connection assembly configured to connect the outer leg portion to the inner leg portion, wherein the connection assembly includes a collar, wherein the outer leg portion includes a plurality of sets of openings configured to receive the pin, wherein each set of openings includes two vertically aligned openings formed in opposite sides of the outer leg portion, wherein each set of openings is vertically spaced-apart from each of the other sets of openings, wherein each set of openings is vertically below the collar, wherein the collar includes a central opening, wherein the central opening includes a first portion and a second portion having a diameter less than the first portion, wherein an upper edge of the outer leg portion is received in the first portion, wherein a first set of fasteners connect the collar to the outer leg portion, and wherein a second set of fasteners connect the collar to the inner leg portion.

10. The system as recited in claim 9, wherein:

the inner leg portion includes a plurality of channels, the second set of fasteners includes a plurality of nuts, each of the nuts is arranged in a corresponding one of the channels, and the second set of fasteners includes a plurality of bolts configured to project through corresponding openings in the collar to engage with a corresponding one of the nuts.

11. The system as recited in claim 10, wherein the plurality of channels are tapered toward a central axis of the inner leg portion.

12. The system as recited in claim 11, wherein:

an outer surface of the inner leg portion is substantially polygonal in cross-section, the outer surface of the inner leg portion includes a plurality of slots, and each of the slots leads to one of the plurality of channels.

13. The system as recited in claim 12, wherein an inner surface of the outer leg portion is substantially polygonal in cross-section and substantially matches a shape of the outer surface of the inner leg portion.

14. The system as recited in claim 13, wherein the inner surface of the outer leg portion and the outer surface of the inner leg portion are both substantially octagonal in cross-section.

15. The system as recited in claim 4, wherein the leg comprises a support channel attached adjacent a top edge of the inner leg portion, wherein the support channel is configured to at least partially support a beam.

16. The system as recited in claim 4, wherein the leg comprises an adjustable leveling foot assembly attached adjacent a bottom edge of the outer leg portion.

17. A method of at least partially filling an orchestra pit or extending a stage, comprising:

erecting a frame assembly by arranging an inner leg portion of a leg partially within an outer leg portion such that a bottom edge of the inner leg portion rests rest on a top of a support fastener inserted through openings in the outer leg portion, wherein the step of erecting the frame assembly includes connecting the inner leg portion to the outer leg portion using a collar, wherein a first set of fasteners connect the collar to the outer leg portion and a second set of fasteners connect the collar to the inner leg portion.

18. The method as recited in claim 17, wherein the step of erecting the frame assembly includes adjusting a leveling foot assembly adjacent a bottom edge of the outer leg portion.

19. The method as recited in claim 17, further comprising:

supporting a tension grid panel or a deck panel using the frame assembly.

* * * * *